US005549126A

United States Patent [19]

Green

[11] Patent Number: 5,549,126

[45] Date of Patent: Aug. 27, 1996

[54] HAIR COLORING DEVICE

[76] Inventor: Gina Green, 2021 Castelar, Omaha, Nebr. 68108

[21] Appl. No.: 371,151

[22] Filed: Jan. 11, 1995

[51] Int. Cl.[6] ..... A45D 19/18

[52] U.S. Cl. ..... 132/270

[58] Field of Search ..... 132/270, 212, 132/222

[56] References Cited

U.S. PATENT DOCUMENTS

| | | | |
|---|---|---|---|
| 4,357,951 | 11/1982 | Aricco | 132/9 |
| 5,056,539 | 10/1991 | Abramson | 132/270 |
| 5,156,172 | 10/1992 | Tancredi | 132/270 |
| 5,335,679 | 8/1994 | Baxter | 132/270 |

FOREIGN PATENT DOCUMENTS

| | | | |
|---|---|---|---|
| 2643239 | 8/1990 | France . | |
| 3829333 | 3/1990 | Germany . | |
| 2096460 | 10/1982 | United Kingdom | 132/270 |

*Primary Examiner*—Todd E. Manahan
*Attorney, Agent, or Firm*—Zarley, McKee, Thomte, Voorhees & Sease; Dennis L. Thomte

[57] ABSTRACT

A device for coloring or frosting hair comprising a first rectangular sheet member which is comprised of a thin, transparent plastic material. Second and third sheet members comprised of aluminum foil are positioned on the first sheet member with the inner edges thereof being spaced to provide a viewing area. A fourth sheet member is secured to the first sheet member above the upper ends of the second and third sheet members and is provided with a plurality of spaced-apart openings formed therein. The fourth sheet member is comprised of a relatively stiff plastic material.

10 Claims, 4 Drawing Sheets

HAIR COLORING DEVICE

BACKGROUND OF THE INVENTION

1. Field of the Invention

This invention relates to a hair coloring device and more particularly to a flat, rectangular sheet-like device having openings formed therein which may be used to color or frost hair.

2. Description of the Related Art

Many types of devices have been previously employed to frost or color hair. For example, in U.S. Pat. No. 4,357,951, a frosting or tipping cap is provided. The cap of U.S. Pat. No. 4,357,951 is somewhat difficult to use in that the cap does not conform to the various high and low spots of the person's head, making a consistent color difficult to achieve. Further, the frosting cap of the '951 patent does not permit the visual observation of the hair, which is to be pulled through the cap, thereby creating an uneven coloring of the hair. Additionally, it is believed that the frosting cap of the '951 patent is difficult to use on thick or long hair because the hair becomes entangled underneath the cap making it difficult and painful to remove. Additionally, it is believed that the frosting cap of the '951 patent must be used by a well-trained cosmetologist having sufficient knowledge as to the amount of hair to be pulled through the large openings since pulling too much hair or too little hair through the openings will create future problems. Additionally, it is believed that the '951 frosting cap is normally used to apply only one color at a time.

Yet another prior art device is disclosed in U.S. Pat. No. 5,056,538. It is believed that the device of the '538 patent relies mainly on the skills of the cosmetologist using the same for proper results. The stylist must manually select the hair that is to be colored, and this skill takes years to develop and can be very time-consuming even for the most skilled designer. Further, the device of the '538 patent does not permit a convenient observation of the hair as it is being colored, which may result in uneven coloring or frosting.

Yet another device is disclosed in U.S. Pat. No. 5,156,172 which requires the use of clamps to hold the device in place. The use of clamps results in the coloring process requiring more time in both in the installation and removal process.

SUMMARY OF THE INVENTION

A hair coloring or frosting device is disclosed which greatly assists the beauty operator in frosting or coloring hair. The device is comprised of a first rectangular sheet member having a top edge, a bottom edge, opposite side edges, and first and second surfaces. The first sheet member is comprised of a transparent, flexible plastic material and is preferably approximately twelve inches long and four inches wide. Second and third rectangular members comprised of aluminum foil or the like are positioned on the first surface of the first sheet member with the inner edges thereof being spaced-apart to define a viewing area therebetween. The upper ends of the second and third sheet members terminate above the upper end of the first sheet member. A fourth sheet member is positioned on the first surface of the first sheet member at the upper end thereof above the upper ends of the second and third sheet members. The fourth sheet member is comprised of a relatively stiff, clear plastic member having a plurality of openings formed therein having a pre-determined diameter and a pre-determined spacing.

It is therefore a principal object of the invention to provide an improved hair coloring device.

Yet another object of the invention is to provide an improved hair coloring device having a viewing area provided thereon which enables the operator to inspect the hair being colored during the coloring process.

Yet another object of the invention is to provide a hair coloring device which is easy to use.

Still another object of the invention is to provide a hair coloring device having openings formed therein of a pre-determined diameter and of a pre-determined spacing which facilitates the proper coloring of the hair.

Still another object of the invention is to provide a hair coloring device which conforms to the shape of a person's head.

Still another object of the invention is to provide a hair coloring device which does not require the use of clamps to maintain the same in position.

Still another object of the invention is to provide a hair coloring device which is economical of manufacture, durable in use and refined in appearance.

These and other objects will be apparent to those skilled in the art.

DESCRIPTION OF THE PREFERRED EMBODIMENT

Figure 1:
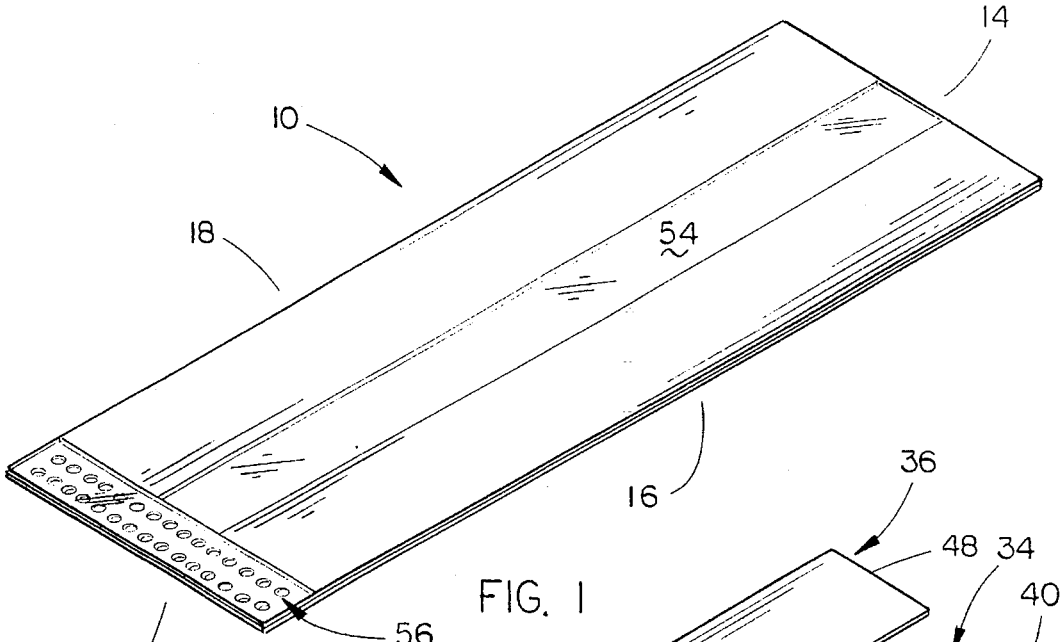
FIG. 1 is a perspective view of the hair coloring device of this invention.
Figure 2:
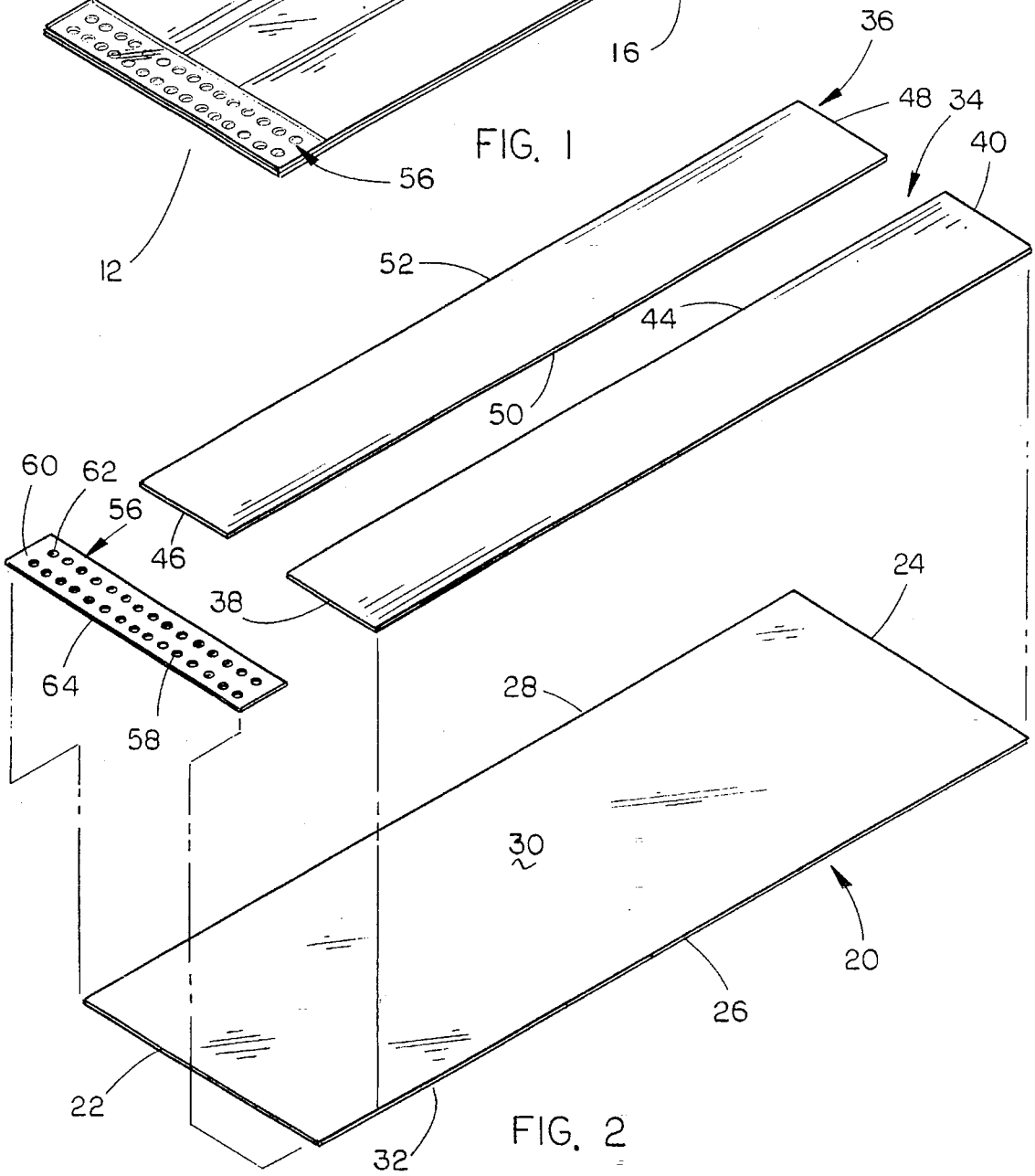
FIG. 2 is an exploded perspective view of the hair coloring device.

The hair coloring device of this invention is referred to generally by the reference numeral 10 including an upper end 12, lower end 14, and opposite sides 16 and 18. Device 10 is comprised of a flat, rectangular sheet member 20 having a top edge 22, bottom edge 24, side edges 26 and 28 and opposite surfaces 30 and 32. Sheet member 20 is preferably comprised of a clear, transparent thermoplastic material and preferably has a width of four inches and a length of twelve inches.

The numerals 34 and 36 refer to rectangular sheet members which are positioned on the surface 30 of sheet member 20. Sheet member 34 includes an upper edge 38, lower edge 40, outer edge 42 and inner edge 44. Similarly, sheet member 36 includes a top edge 46, bottom edge 48, inner edge 50 and outer edge 52. Preferably, sheet members 34 and 36 are comprised of a flexible metal material such as aluminum foil or the like. Preferably, each of the sheet members 34 and 36 have a length of eleven and one-quarter inches and a width of one and one-half inches. It can be seen in the drawings that the inner edges 44 and 50 of sheet members 34 and 36 are spaced from one another to provide a viewing area generally referred to by the reference numeral 54.

The numeral 56 refers to a relatively stiff sheet member preferably comprised of a clear plastic material and having a plurality of openings 58 formed therein. Preferably, the openings 58 are aligned in a top row 60 and a bottom row 62. Preferably, the distance from the center of each of the openings 58 in row 60 is approximately one-quarter inch from the top edge 64. Preferably, the openings 58 in row 62 are located directly below the openings 58 in row 60 as seen in the drawings. Preferably, the distance between the centers of each of the openings in each of the rows is approximately one-quarter inch. Preferably, the distance between the centers of the openings 58 in row 60 and the openings 58 in row 62 are approximately one-quarter inch. Preferably, the distance between the top and bottom edges of sheet 56 is three-quarter inch.

Figure 3A:
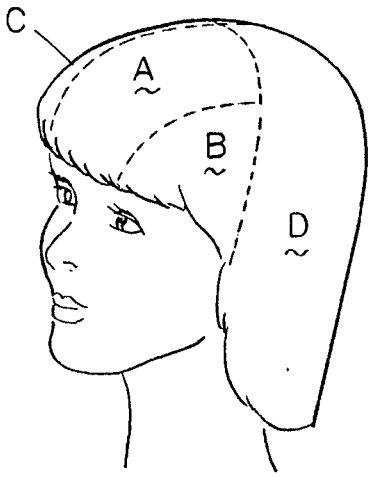
FIG. 3A is a view of a person's head illustrating the manner in which the hair is segmented.
Figure 3B:
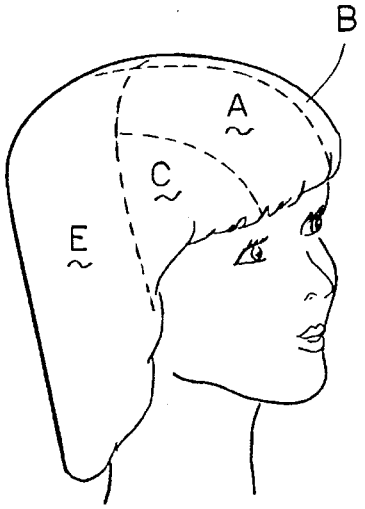
FIG. 3B is a view similar to that if FIG. 3A.

The normal method of use of the device 10 is as follows. Initially, the hair on the person's head is sectioned into three to four inch wide rectangular panels as illustrated in FIGS. 3A and 3B. Section A is in the top of the head from the forehead to the crown. Sections B and C are located on the sides of the head and extend from the front hairline to the top of the middle of the ear. Sections D and E cover the back of the head from the crown to the nape of the neck dividing the sections vertically down the center of the back. All panels are defined vertically on the head. Once the head has been sectioned, the invention may be used.

Figure 4:
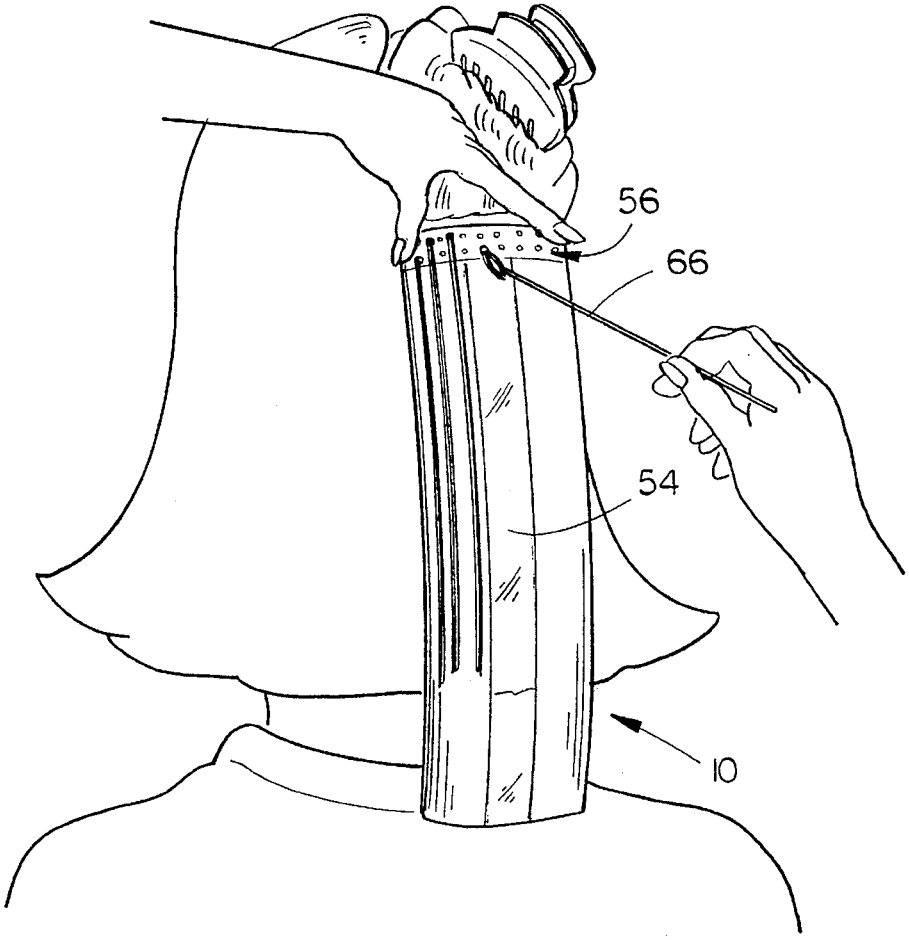
FIG. 4 is a view illustrating the device of this invention being used.
Figure 5:
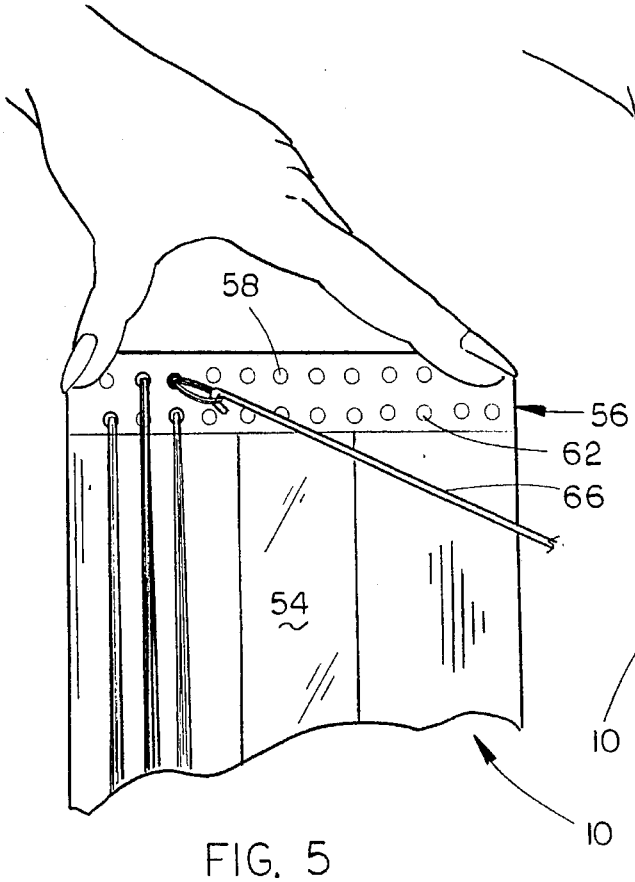
FIG. 5 is a view illustrating hair being pulled through one of the openings in the device.

Beginning at the bottom of any section or panel, the hair is parted into approximately one-half inch wide horizontally disposed sections combing the hair downwardly. The remainder if the hair is clipped up out of the way. The upper end 12 of the device 10 is then placed parallel to and even with the part line formed in the hair such as illustrated in FIG. 4. Device 10 is held in place with the thumb and index finger of the user at each end of the sheet member 56 as illustrated in FIG. 4. While the device 10 is held in place as illustrated in FIG. 4, a conventional hook 66 is used to pull the desired pieces of hair to be colored through the openings 58 in the sheet member 56. The hair not to be colored is left beneath the device 10 to protect it from the coloring process. The thin plastic member 20 which is positioned beneath the sheet member 56 must be punctured corresponding to registering openings 58 to bring the desired hair into view. The plastic sheet member 20 beneath the sheet member 56 protects the hair beneath any unused openings from the coloring agent bleeding through.

Figure 6:
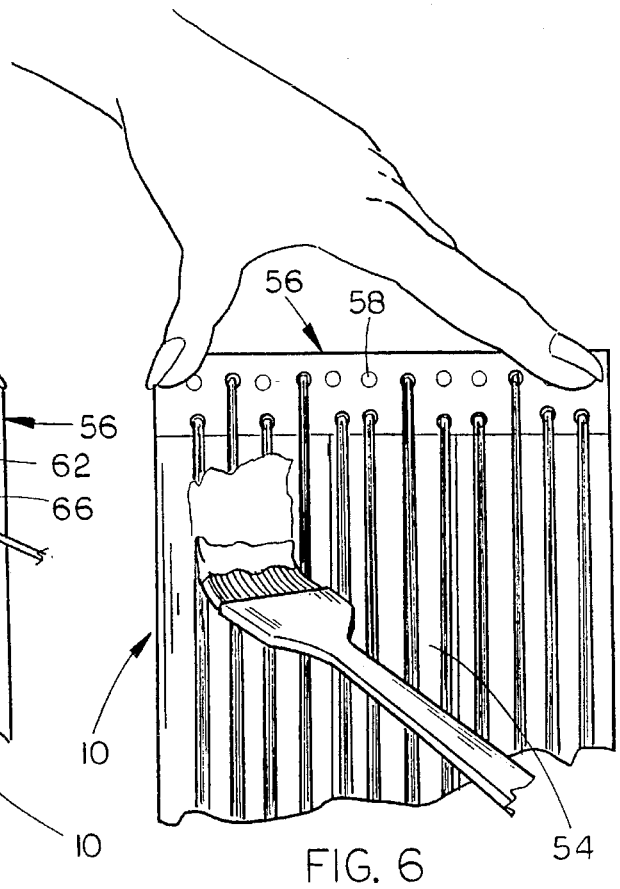
FIG. 6 is a view illustrating the coloring material being applied to the hair which has been pulled through openings in the device.
Figure 7:
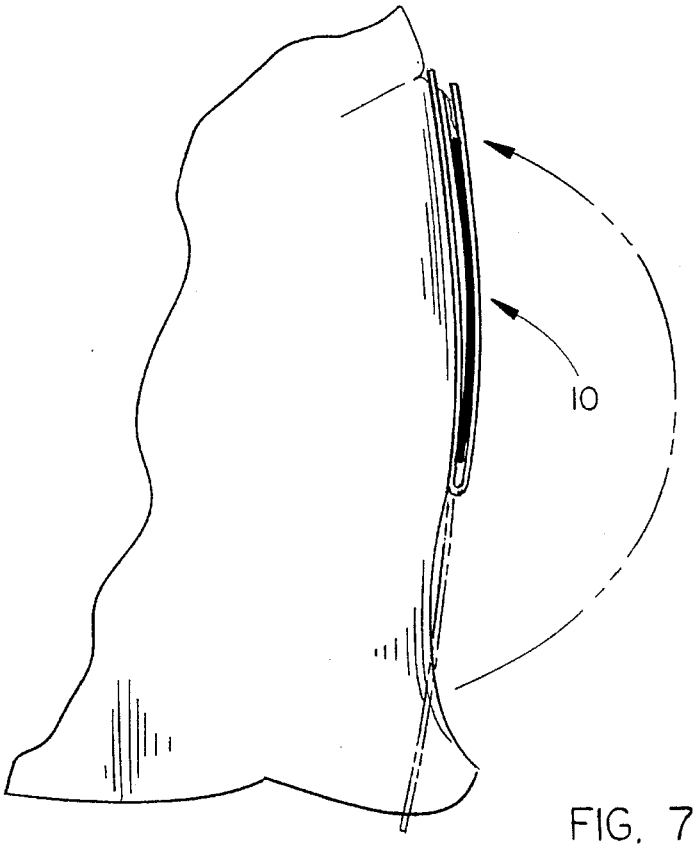
FIG. 7 is a side view illustrating the device having being folded upon itself to permit the coloring agent to color the hair.
Figure 8:
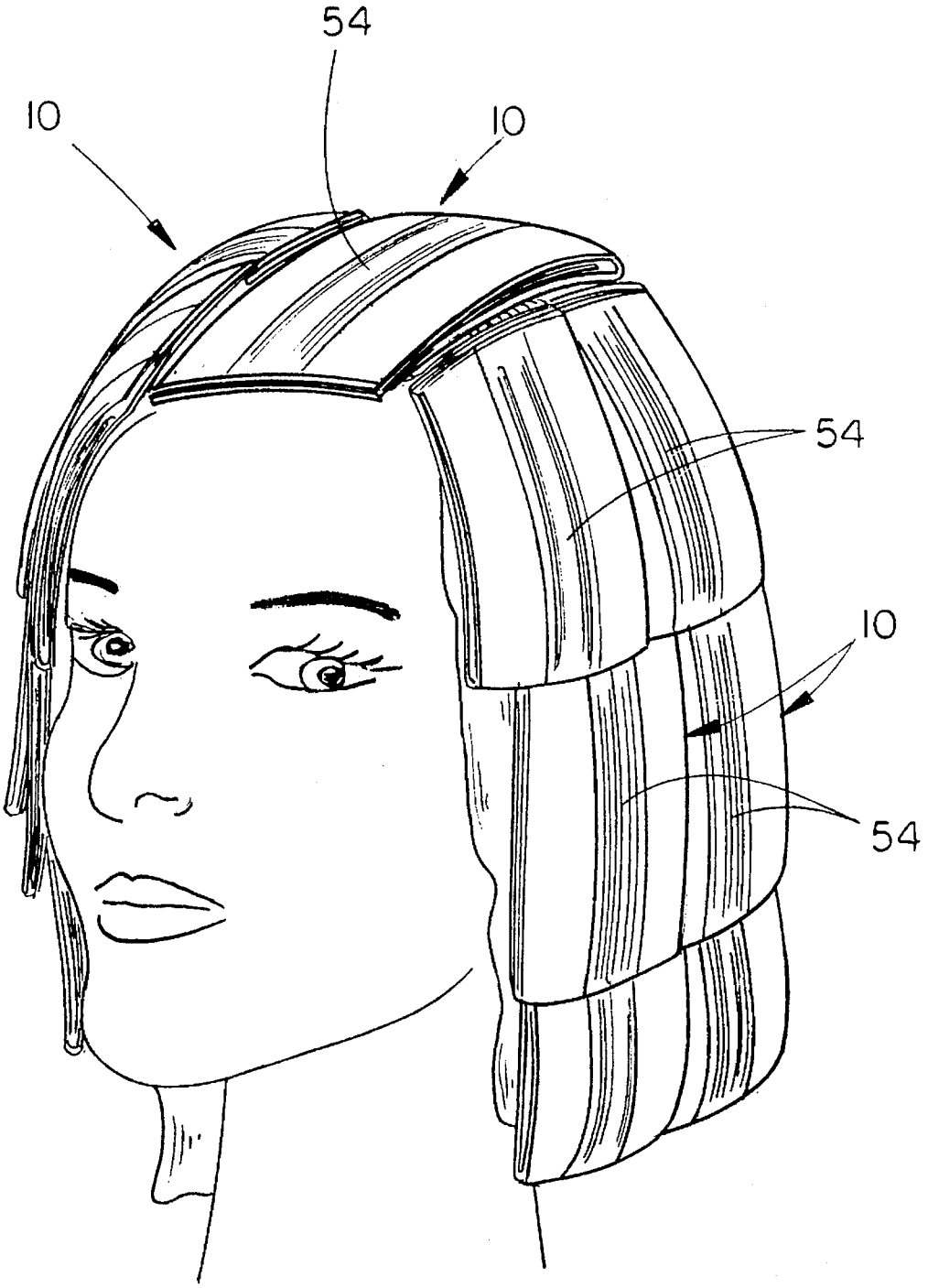
FIG. 8 is a view of a person's head with multiple devices applied thereto.

Once the desired amount of hair has been pulled into view as illustrated in FIG. 6, the coloring agent is then applied with a tint brush or bottle. The coloring agent will then hold the device 10 in place so that both hands are free to use to fold the lower end of the device upwardly onto the upper end of the device to contain the color agent while processing. The aluminum foil sheet members 34 and 36 provide sufficient strength to the device to keep the device from falling downwardly or unfolding until it is manually unfolded. Such is not possible with the current devices made only of plastic or paper. The aluminum foil composition of the sheet members 34 and 36 also retain heat which is necessary for many coloring agents used today.

The viewing area 54 permits the user to see the hair as the coloring agent is working without disturbing the device 10 once it is in place, thereby providing a more accurate coloring service to the client. When the coloring agent has sufficiently colored the hair, the device 10 is unfolded and gently pulled from the hair.

The size of the openings 58 and the spacing of the openings 58 ensures that the user will not pull too much hair through the openings and that the colored hair will have a nice appearance. Further, the construction of the device 10 enables the device to conform to curvatures of the head as illustrated in FIG. 4. The device is extremely easy to use and is economical of manufacture. Further, the device of this invention permits the frosting or coloring of hair in a much more efficient manner than permitted by the prior art devices. Thus it can be seen that the invention accomplishes at least all of its stated objectives.

I claim:

1. A hair coloring device comprising:

a first flat, rectangular sheet member having a top edge, a bottom edge, opposite side edges, and first and second surfaces;

said first sheet member being comprised of a transparent, flexible thermoplastic material;

a second, flat, rectangular sheet member secured to said first surface of said first sheet member adjacent one side edge thereof, said second sheet member having a top edge, a bottom edge, and inner and outer side edges, said upper edge of said second sheet member being positioned below the upper end of said first sheet member;

a third, flat, rectangular sheet member secured to said first surface of said first sheet member adjacent the other side edge thereof, said second sheet member having a top edge, a bottom edge, and inner and outer edges, said upper edge of said third sheet member being positioned below the upper end of said first sheet member;

said second and third sheet member being comprised of a relatively thin metal material;

said inner edges of said second and third sheet members being spaced-apart to permit a viewing area therebetween;

and a fourth flat, rectangular sheet member having a top edge, a bottom edge, and opposite side edges, secured to said first surface of said first sheet member above the upper ends of said second and third sheet members;

said fourth sheet member being comprised of a relatively stiff material;

said fourth sheet member having a plurality of openings formed therein to enable hair to be pulled therethrough providing registering openings have been created in said first sheet member.

2. The hair coloring device of claim 1 wherein said first sheet member has a width of approximately four inches.

3. The hair coloring device of claim 2 wherein each of said second and third sheet members have a width of approximately one and one-half inches.

4. The hair coloring device of claim 3 wherein said fourth sheet member has a length of approximately four inches.

5. The hair coloring device of claim 1 wherein said first sheet member has a length of approximately twelve inches.

6. The hair coloring device of claim 1 wherein said second and third sheet members are each comprised of an aluminum foil material.

7. The hair coloring device of claim 1 wherein said fourth sheet member is comprised of a thermoplastic material.

8. The hair coloring device of claim 1 wherein the distance between the top and bottom edges of said fourth sheet member is approximately three-fourths inch.

9. The hair coloring device of claim 1 wherein the distance between said openings is approximately one-fourth inch.

10. A hair coloring device comprising:

a first flat, rectangular sheet member having a top edge, a bottom edge, opposite side edges, and first and second surfaces;

said first sheet member having a transparent hair viewing window formed therein between the opposite side edges;

said first sheet member having a plurality of openings formed therein;

and a second flat, rectangular sheet member, having a top edge, a bottom edge, and opposite side edges, secured to said first surface of said first sheet member at the upper end thereof which extends between said side edges of said first sheet member;

said second sheet member being comprised of a relatively stiff material;

said second sheet member having a plurality of openings formed therein which register with said openings in said first sheet member to enable hair to be pulled therethrough;

and a relatively thin metal sheet member positioned on said first sheet member for heat retention and strengthening purposes.

* * * * *